US009060221B1

(12) United States Patent
Kaplan

(10) Patent No.: US 9,060,221 B1
(45) Date of Patent: Jun. 16, 2015

(54) SAFETY HELMET WITH SPEAKER ASSEMBLY

(71) Applicant: Ari A. Kaplan, Miami, FL (US)

(72) Inventor: Ari A. Kaplan, Miami, FL (US)

( * ) Notice: Subject to any disclaimer, the term of this patent is extended or adjusted under 35 U.S.C. 154(b) by 249 days.

(21) Appl. No.: 13/724,460

(22) Filed: Dec. 21, 2012

(51) Int. Cl.
*H04R 3/00* (2006.01)
*H04R 1/02* (2006.01)

(52) U.S. Cl.
CPC ..... *H04R 1/028* (2013.01)

(58) Field of Classification Search
USPC ..... 381/120, 415, 77–79, 85, 300, 376, 381/386, 387; 455/414.1; 707/769
See application file for complete search history.

(56) References Cited

U.S. PATENT DOCUMENTS

| | | | |
|---|---|---|---|
| 2,497,871 | A | 2/1950 | Eash |
| 3,258,534 | A | 6/1966 | Goldsworthy |
| 3,629,522 | A | 12/1971 | Richards |
| D284,612 | S | 7/1986 | Gorman |
| 4,979,586 | A | 12/1990 | Lazzeroni et al. |
| 5,119,505 | A | 6/1992 | Tisseront et al. |
| 5,465,421 | A | 11/1995 | McCormick et al. |
| 5,615,410 | A | 3/1997 | DeMars |
| 5,953,434 | A | 9/1999 | Boyden |
| 6,017,049 | A | 1/2000 | Spector |
| 6,725,020 | B2 | 4/2004 | Yagi |
| 6,732,381 | B1 | 5/2004 | Lal |
| 6,798,392 | B2 | 9/2004 | Hartwell et al. |
| 6,862,358 | B1 | 3/2005 | Tabata |
| 6,970,691 | B2 | 11/2005 | Thompson |
| 7,095,315 | B2 | 8/2006 | Lemke |
| 7,130,436 | B1 | 10/2006 | Tabata et al. |
| 7,519,405 | B1 | 4/2009 | Brent |
| 8,001,623 | B2 | 8/2011 | Gertsch et al. |
| 8,014,556 | B2 | 9/2011 | Goldberg |
| 8,117,676 | B1 | 2/2012 | Cardoso |
| 2002/0176595 | A1 | 11/2002 | Lazzeroni et al. |
| 2004/0105566 | A1 | 6/2004 | Matsunaga et al. |
| 2004/0226079 | A1 | 11/2004 | Rainey |
| 2008/0295224 | A1 | 12/2008 | Mintzer |
| 2008/0317263 | A1 | 12/2008 | Villareal, Jr. |
| 2011/0087690 | A1* | 4/2011 | Cairns ..... 707/769 |
| 2012/0077549 | A1 | 3/2012 | Gibbons |
| 2012/0282905 | A1* | 11/2012 | Owen ..... 455/414.1 |

FOREIGN PATENT DOCUMENTS

WO WO2012082839 A1 * 6/2012 ..... A42B 1/24

* cited by examiner

*Primary Examiner* — Md S Elahee
(74) *Attorney, Agent, or Firm* — Albert Bordas, P.A.

(57) ABSTRACT

A safety helmet having a protective shell head covering and a front edge, a rear edge, and first and second lateral edges. A speaker assembly has at least one speaker mounted onto the helmet and aimed outwardly therefrom. The speaker assembly has means to receive audio signals from a portable sound signal-producing device. The at least one speaker mounted onto the helmet and aimed outwardly therefrom emanates sound directed approximately perpendicularly from the protective shell head covering without blocking surrounding sound, and without affecting safety aspects of the helmet.

14 Claims, 6 Drawing Sheets

SAFETY HELMET WITH SPEAKER ASSEMBLY

BACKGROUND OF THE INVENTION

1. Field of the Invention

The present invention relates to helmets, and more particularly, to safety helmets having speaker assemblies mounted thereon.

2. Description of the Related Art

Applicant believes that one of the closest references corresponds to U.S. Pat. No. 6,970,691 B2 issued to Thompson on Nov. 29, 2005 for Sports Helmet Having Integral Speakers. However, it differs from the present invention because Thompson teaches a sports helmet including a liner comprised of impact resistant material and a protective shell encasing an outer surface of the liner. A female audio jack is secured within a rear cavity of the liner and has an aperture extending without the liner for receiving a male audio jack connected to a portable audio device. A pair of cavities are formed on opposite sides of the liner in which are secured speakers. Wiring extends from the female audio jack to the integral speakers. The speakers are positioned and oriented such so as to provide audio to the helmet wearer without blocking surrounding sound, and without affecting the safety aspects of the helmet.

Applicant believes that another reference corresponds to U.S. Pat. No. 8,117,676 B1 issued to Cardoso on Feb. 21, 2012 for Hardhat with Vent Strip and Lighting Configuration. However, it differs from the present invention because Cardoso teaches a hardhat that provides ventilation and controlled lighting. A crown of a modified semi-spherical shape terminates downwardly with a generally oval peripheral edge in a horizontal plane, the crown having a plurality of apertures therein arranged in spaced apart sequence, and a flexible venting strip fixed forwardly on the crown and extending over the apertures, the venting strip positionable in each of a plurality of arcs above the crown, wherein each one of the arcs provides a selectable ventilation conductance into the hardhat. A brim is joined integrally to the peripheral edge of the crown extending outwardly. An electrical circuit has components including: a head-lamp mounted forward on the hardhat, a series of individual lights mounted in spaced-apart positions circumventing the crown, and a manual control mounted on the brim, the manual control is enabled for setting the electrical circuit in a standard operating mode wherein the head-lamp and individual lights are activated, and in a distress operating mode wherein the individual lights are red in color and set to blinking, and in an emergency mode wherein a loudspeaker and radio distress beacon are activated.

Applicant believes that another reference corresponds to U.S. Pat. No. 8,014,556 issued to Goldberg on Sep. 6, 2011 for Speaker System for Head Protective Gear. However, it differs from the present invention because Goldberg teaches a headgear system enhanced for generating sound has at least one speaker apparatus connected to or integrated into the structure of the headgear system, the speaker apparatus including a magnet suspended in a magnetic fluid, and at least one resonator connected to the at least one speaker apparatus. The system is characterized in that excitation of the magnet produces vibration translated to the resonator to generate the sound.

Applicant believes that another reference corresponds to U.S. Pat. No. 8,001,623 issued to Gertsch et al. on Aug. 23, 2011 for Electronic Helmet. However, it differs from the present invention because Gertsch, et al. teach an electronic helmet that includes a helmet body and an integrated electronic system disposed in the helmet body, providing a number of convenient functions. The helmet body has a hard outer shell and a hard inner shell mounted to the outer shell such that a cavity is defined between the outer and the inner shells. The inner shell can include suitable material to provide the wearer effective RF shielding from the electronic system, such as, nickel-plated carbon fiber to provide RF shielding. The helmet body further includes a shock-absorbent structure disposed between the inner shell and the head of a wearer.

Applicant believes that another reference corresponds to U.S. Pat. No. 7,519,405 issued to Brent on Apr. 14, 2009 for Motorcycle Helmet. However, it differs from the present invention because Brent teaches a motorcycle helmet that permits a user to listen to a compact disk while wearing a helmet. The motorcycle helmet includes a helmet being designed for protecting a head of a user from impact. The helmet has a perimeter wall defining an interior space. A playing assembly is positioned in the perimeter wall of the helmet. The playing assembly is designed for reading audio information from a compact disc. Each of a plurality of speakers is positioned in the perimeter wall of the helmet. Each of the speakers is operationally coupled to the playing assembly. Each of the speakers is designed for audibly playing the audio information read by the playing assembly.

Applicant believes that another reference corresponds to U.S. Pat. No. 7,130,436 issued to Tabata, et al. on Oct. 31, 2006, for Helmet with Built-in Speaker System and Speaker System for Helmet. However, it differs from the present invention because Tabata, et al. teaches a speaker system installed in a helmet, including a pair of piezoelectric speakers, frames supporting the speakers around the peripheral edges thereof, and laminated films for protecting the piezoelectric film speakers. Each of the frames has its longer sides curved with a radius of curvature of 210 mm to 360 mm in order to support the piezoelectric film speakers in a curved state similarly to the frame.

Applicant believes that another reference corresponds to U.S. Pat. No. 6,862,358 issued to Tabata on Mar. 1, 2005 for Piezo-film Speaker and Speaker Built-in Helmet Using the Same. However, it differs from the present invention because Tabata teaches a flat piezo-film speaker mounted in a motorcycle helmet. The flat-piezo film speaker is formed from a flat piezo-film curved in one direction to form at least one curved portion. A radius R of curvature at the curved portion is larger than at least 200 mm, preferably, in a range of 210 mm.l-toreq.R.ltoreq.360 mm. The piezo-film speaker built into a helmet for a motorcycle rider is capable of reproducing sound at a sound pressure sufficiently audible even when running the motorcycle and at a high tone quality.

Applicant believes that another reference corresponds to U.S. Pat. No. 7,095,315 issued to Lemke on Aug. 22, 2006 for Collision Avoidance System for Snowmobiles. However, it differs from the present invention because Lemke teaches a collision avoidance system for snowmobiles that includes an array of sensors positioned on a front side of the snowmobile for detecting the presence and location of an approaching obstacle. The sensors include both heat sensors and speed sensors. A control unit is provided for processing signals received from the sensors and outputting audio signals indicative of the detected location of the approaching obstacle. A wireless transmitter transmits the audio signals to a receiver and speaker system contained in a headset or helmet. The speaker system includes left and right speakers contained in the headset or helmet which are adapted to be positioned near or within the driver's left and right ears and provide audible warnings to the driver. The control unit varies a loudness of the audible warnings in the left and right speakers to indicate a direction from which the detected obstacle is approaching.

Applicant believes that another reference corresponds to U.S. Pat. No. 6,798,392 issued to Hartwell, et al. on Sep. 28, 2004 for Smart Helmet. However, it differs from the present invention because Hartwell, et al. teaches a smart helmet that includes integrated electronics. Helmet features includes a global locating system, an environmental interaction sensor, a mobile communications network device, a small display panel, a microphone and at least one speaker. The helmet is aware of the user's location and interactions with the environment. The helmet can provide data to a user, monitor the user's actions and condition, and send information to others about user's location and condition.

Applicant believes that another reference corresponds to U.S. Pat. No. 6,732,381 issued to Lal on May 11, 2004 for Sports Helmet. However, it differs from the present invention because Lal teaches a sports helmet including features such as an mp3 player, a radio, and a cellular telephone. The sports helmet includes a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

Applicant believes that another reference corresponds to U.S. Pat. No. 6,725,020 issued to Yagi on Apr. 20, 2004 for Helmet with Incorporated Communication System. However, it differs from the present invention because Yagi teaches a helmet with incorporated communication system including a helmet dimensioned for being positioned on a head of a motorcyclist. The helmet has a communications system incorporated therein comprised of a speaker and a microphone. A control panel is secured to a motorcycle. The control panel is in communication with the communications system of the helmet. The control panel includes a radio with a mini-disk player, a cellular telephone, and a navigation system. A sensor is disposed within the helmet. The sensor is capable of sending a distress signal once an impact on the helmet has been sensed.

Applicant believes that another reference corresponds to U.S. Pat. No. 6,017,049 issued to Spector on Jan. 25, 2000 for Interactive Safety Helmet for Bicyclists. However, it differs from the present invention because Spector teaches an interactive safety helmet for a bicyclist, making it possible for a group of bicyclists wearing like helmets to communicate with each other and thereby coordinate their activities. The helmet is formed by an outer shell shaped to fit onto the head of the bicyclist and an inner cushioning liner having a pair of miniature loud speakers embedded therein at opposing sides adjacent the ears of the bicyclist. Extending from the shell is a gooseneck supporting a microphone at a position adjacent the mouth of the bicyclist. Mounted on the shell is a miniature radio transceiver whose transmitter section is coupled to the microphone and whose receiver section is coupled to the loud speakers. The transceiver is connected by a line extending from the helmet to an external battery power pack. In operation, a bicyclist wearing the helmet can by talking into the microphone and listening to the loud speakers interact with other bicyclists in the group. The helmet is also provided on either side thereof with an LED safety flashing light powered by the same power pack.

Applicant believes that another reference corresponds to U.S. Pat. No. 5,953,434 issued to Boyden on Sep. 14, 1999 for Headband with Audio Speakers. However, it differs from the present invention because Boyden teaches a device with a speaker system and adapted to wear on the head of a wearer, such as a headband. Transducers are situated in a wearable device and positioned on opposite sides of the wearer's head, adjacent the ears. The transducers share a common enclosure and are driven 180 degree out of phase, so that back pressures cancel and low frequency response is enhanced. In another embodiment, two vented enclosures are provided, each with its own transducers. In other embodiments, acoustic concentrators can be incorporated to direct the audio more directly toward the wearer's ears. The speaker system is connected to or in communication with a conventional source of audio signals, such as a radio, tape player, CD player, cellular telephone or the like.

Applicant believes that another reference corresponds to U.S. Pat. No. 5,615,410 issued to DeMars on Mar. 25, 1997 for Head Wear Communication System. However, it differs from the present invention because DeMars teaches a communication system to be used between a plurality of individuals with the communication system being mounted in conjunction with head wear. Generally, the individuals are engaged in some type of related activity such as riding bicycles. Within each head wear is incorporated a receiver that is to be located directly adjacent an ear of the user. Also mounted on the head wear of each user is an elongated unit with this elongated unit including a microphone in one end thereof and an antenna at the opposite end thereof. This unit is pivotally mounted on the head wear between an inactive position and a using position. When in a using position, the microphone is located directly adjacent to the mouth of the user. When in the inactive position, the microphone is located in an out-of-the-way position spaced some distance from the mouth of the user.

Applicant believes that another reference corresponds to U.S. Pat. No. 5,465,421 issued to McCormick, et al. on Nov. 7, 1995 for Protective Sports Helmet with Speakers, Helmet Retrofit Kit and Method. However, it differs from the present invention because McCormick, et al. teaches a sports helmet with portable audio sound producing capabilities for use on a wearer's head during physical exercise or sports activities at which head injuries are to be protected against. There is a protective shell head covering composed of impact absorbing material, which has downwardly facing rim portions terminating above the wearer's ear canals. Straps are provided for removably fastening the protective shell on a wearer's head. A sound speaker is attached at the downwardly facing rim portions above the wearer's ear canal. The speaker is spaced away from the ears so that the ear canals are not shielded. The speaker is aimed so that sound emitted therefrom is primarily directed downwardly past the wearer's ear canal. Other sounds, warnings, or communications from the surroundings can also be heard. A portable sound signal producing device communicates signals to the speaker for causing desirable sounds to be emitted from the speakers during physical exercise or sports activity. Two speakers may be similarly provided, one on each side, for stereo sound.

Applicant believes that another reference corresponds to U.S. Pat. No. 5,119,505 issued to Tisseront, et al. on Jun. 2, 1992 for Protective Helmet with Removable Protective Lining for Cushioning Radio Circuitry. However, it differs from the present invention because Tisseront, et al. teaches a protective helmet comprising an impact-resistant outer helmet shell into which a head padding (10) is removably inserted as separate inner helmet shell. The protective helmet is provided with radiotelephone equipment. With the exception of a microphone and possibly an on/off switch and a battery charge check indicator all the parts of the radiotelephone equipment are provided in recesses (32a 32b, 36-46) provided for them in the head padding (10) at the back at the rear side and at the lower peripheral edge thereof. The two recesses (36, 46) for the two loudspeakers are connected via acoustic passages formed in the head padding (10) to an acoustic cavity provided at ear level. As a result, in the temple and ear region the protective helmet is free from any metal or plastic parts, which might cause injury in the event of an impact. In addition, the position of the radiotelephone equipment is chosen so that the equilibrium of the protective helmet is practically not impaired.

Applicant believes that another reference corresponds to U.S. Pat. No. 4,979,586 issued to Lazzeroni, et al. on Dec. 25, 1990 for Acoustically shielded motorcycle helmet speaker enclosure. However, it differs from the present invention because Lazzeroni, et al. teaches an acoustically shielded speaker enclosure for use in the ear pockets of motorcycle helmets, wherein parasitic sound waves emitted from the rear side of an enclosed audio loudspeaker are prevented from entering the motorcycle rider's ear and from mixing with and distorting the primary sound waves issued from the audio loudspeaker directed at the rider's ear. The acoustically shielded speaker enclosure consists of a pair of joined together cup-shaped housing assemblies forming a shortened cylinder adapted to enclose and secure an audio loudspeaker, the enclosure having openings in one face of the housing assemblies to allow passage of the primary sound waves from the contained loudspeaker. An acoustic shield attached to the speaker enclosure cylindrical side extends to the edge of the ear pocket and is sealed there. The parasitic sounds emanating from the rear of the loudspeaker through the rear of the speaker enclosure are this prevented from coming around the speaker enclosure by the acoustic shield to enter the rider's ear or to mix with and distort the primary sound waves.

Applicant believes that another reference corresponds to U.S. Pat. No. 3,629,522 issued to Richards on Dec. 21, 1971 for Headpiece Loudspeaker. However, it differs from the present invention because Richards teaches a headpiece loudspeaker having a headpiece incorporating a loudspeaker oriented so as to propagate acoustical energy from opposite sides of the headpiece. The side lobe propagation emanating from each side of the headpiece forms, in combination, a substantially "figure eight" configuration offering approximately 360 degree distribution of the acoustical energy emanating from a single loudspeaker. The headpiece is provided with a crown and, in one form, a detachable mount carries the loudspeaker thereon. In another form, the loudspeaker is fixed to the crown of the headpiece and a diverter baffle is disposed in fixed opposing spaced relationship to the vibrating cone of the loudspeaker that is adapted to translate acoustical energy into truly 360-degree distribution or excursion.

Applicant believes that another reference corresponds to U.S. Pat. No. 3,258,534 issued to Goldsworthy on Jun. 28, 1966 for Safety Headpiece Loudspeaker. However, it differs from the present invention because Goldsworthy teaches a loudspeaker mechanism wherein portions of the mechanism except the microphone are embodied within the crown portion of a safety head piece or helmet, and the microphone is adjustably mounted on the head piece for positioning in front of a wearer's mouth.

Applicant believes that another reference corresponds to U.S. Pat. No. 2,497,871 issued to Eash on Feb. 21, 1950 for Helmet. Mounted Loud-Speaker. However, it differs from the present invention because Eash teaches means mounting a loud speaker on the headgear of a person by means of which the speaker's voice as directed into a microphone is greatly amplified to issue in a direction responsive to head turning movements.

Applicant believes that another reference corresponds to U.S. Pat. No. D284612 issued to Gorman on Jul. 15, 1986 for Helmet. However, it differs from the present invention because Gorman teaches a specific design for a helmet physically different from Applicant's.

Applicant believes that another reference corresponds to U.S. Patent Application Publication No. 2012/0077549, published on Mar. 29, 2012 to Gibbons for Sports Musicom Headset. However, it differs from the present invention because Gibbons teaches a Sports MusiCom headset (10) adapted for use with cellular telephones comprising at least one speaker (28) and microphone (30) mounted within helmet liner (20) suitable for use in conjunction with a variety of sports and recreational activities. Speaker (28) and microphone (30) are held in place by detachable fastening means, e.g. a hook and loop fastening system, or stretchable fabric, so they may be removed to wash helmet liner (20). Chin strap (32) is also held in place by detachable fastening means or stretchable fabric. Microphone (30) is contained within a pocket of chin strap (32) so as to rest microphone (30) against the wearer's throat, thereby minimizing disturbances from external sources, such as wind. Slap switch (60) is a relatively large (ideally, four square inch) call answer button that allows easy answering of telephone calls, even if the wearer is in motion or wearing gloves that would render the operation of prior art call answer buttons difficult or impossible. Breakaway connector (40) is provided between helmet liner (20) and slap switch (60) to prevent wires from snagging on foreign objects, and to allow separation of helmet liner (20) from the remaining components of Sports MusiCom headset (10). A further embodiment incorporates standard headphone and microphone connections (85, 86) for compatibility with a wearer's headset of choice, and which may also incorporate slap switch (60). "Patch" cables may be included to allow use of the headset device with different cellular telephone models, which may contain nonstandard audio input/output connections.

Applicant believes that another reference corresponds to U.S. Patent Application Publication No. 2008/0317263, published on Dec. 25, 2008 to Villareal, Jr. for Voice Amplification System for Signal Calling During the Play of a Sports Competition. However, it differs from the present invention because Villareal, Jr. teaches a system that allows the teammates of an individual (such as a quarterback on a football team) to hear signals being called by that individual during the course of a sports competition, despite noise generated by an audience. The system includes a microphone positioned within the helmet of the signal caller connected to an audio amplification device, either positioned in the helmet or in some other part of the clothing or equipment worn by the signal caller. The amplified signal is then directed to one or more loudspeakers, again positioned either on the helmet of the signal caller or on the clothing or equipment worn by the signal caller. The loudspeakers are directed to the signal caller's teammates, positioned typically along a line of scrimmage. The system may be time-limited in operation in that the signal caller must specifically activate the system, which thereafter remains activated only for a pre-set period of time before automatically shutting off. The components of the system may be connected to each other by wired or wireless signal lines.

Applicant believes that another reference corresponds to U.S. Patent Application Publication No. 2008/0295224, published on Dec. 4, 2008 to Mintzer for Audio Broadcasting Hat. However, it differs from the present invention because Mintzer teaches a hat that incorporates an audio system configured to externally broadcast audio stored by the audio system. The hat includes a digital audio player such as an MP3 player or the like that is connected to speakers of the audio system. The speakers are mounted in pivoting flaps of the hat such that the flaps and thus the speakers are movable into an open position and a closed position. In the open position, the speakers are positioned to externally broadcast audio; and in the closed position, the speakers are positioned to internally play audio for the wearer or not play audio at all. The hat also incorporates user controls for the digital audio player in the brim of the hat. The hat may also include a light system that is controlled by an integral light controller for various light effects with a user control incorporated in the brim of the hat. The light system preferably includes one or more LEDs that are mounted on a front of the hat and connected to the light controller. The light controller may be associated with the audio system to provide light effects in concert with the audio being played.

Applicant believes that another reference corresponds to U.S. Patent Application Publication No. 2004/0226079, published on Nov. 18, 2004 to Rainey for Helmet Having Audio Features. However, it differs from the present invention because Rainey teaches a safety helmet for bikers, skateboarders, rollerbladers and the like adapted to include a standalone player such as a compact disc player and/or digital audio player mounted in or on its head-protective shell. Controls for the player are within or directly on the helmet, and earphones are suitably located at a user's ears. Music files or other information may be charged or loaded from a computer, for example in MP3 format, directly into the helmet for subsequent playback. An ambient sound sensor on a rear portion of the helmet senses traffic sounds for the user's safety. Entertainment offered by the helmet will encourage people, particularly children, to wear the helmet, thus encouraging safety and saving lives.

Applicant believes that another reference corresponds to U.S. Patent Application Publication No. 2004/0105566, published on Jun. 3, 2004 to Matsunaga, et al. for Body Set Type Speaker Unit. However, it differs from the present invention because Matsunaga, et al. teaches an ear-hanging type speakerphone unit that allows users to listen to both sounds from the speaker and sounds from the outside environment, while suppressing leakage of the sounds emanating from the speaker to the outside environment. A directional speaker is adjustably held with its speaker face being, for example, approximately 1 to 2 cm. away from the opening of an external auditory miatus, such that an open air space is formed between the speaker face and the opening of the miatus.

Applicant believes that another reference corresponds to U.S. Patent Application Publication No. 2002/0176595, published on Nov. 28, 2002 to Lazzeroni, et al. for Clampless Headset Mounting Assembly. However, it differs from the present invention because Lazzeroni, et al. teaches a clampless mounting assembly for use with a helmet for attaching an internal headset to one of a plurality of different types of external electronic audio communications devices. External audio communications devices communicate with an internal headset by way of electrical conductors inherent in a mounting post. The mounting post is inserted through a hole in the helmet. The mounting post comprises a base on one end and a retainer on the other end to secure the headset to the helmet, eliminating the need for clamps or adhesives. The electrical conductors may be used in a variety of configurations for connecting the headset to one of a plurality of different types of audio communications devices. An external cable, connected to an external audio communications device, is inserted into an external connector inherent in the mounting post.

Other patents describing the closest subject matter provide for a number of more or less complicated features that fail to solve the problem in an efficient and economical way. None of these patents suggest the novel features of the present invention.

SUMMARY OF THE INVENTION

The present invention is a safety helmet having speaker assemblies, positioned and oriented such so as to provide external audio to the helmet wearer without blocking surrounding sound, and without affecting the safety aspects of the helmet, whereby the speaker assemblies are mounted onto a helmet.

More specifically, the present invention is a safety helmet, comprising a helmet; and a speaker assembly comprising at least one speaker mounted onto the helmet. The at least one speaker is aimed outwardly therefrom, and the speaker assembly comprises means to receive audio signals. The at least one speaker mounted onto the helmet is aimed outwardly therefrom, emanating sound directed approximately perpendicularly from the helmet without blocking surrounding sound.

The present invention further comprises a strap assembly. The helmet comprises front and rear edges, and lateral edges. The speaker assembly is integrally mounted onto the helmet, and in a preferred embodiment, the at least one speaker is countersunk.

The audio signals may be stored and/or emanate from cloud storage. The audio signals may also stream through a portable sound signal-producing device. The portable sound signal-producing device is a portable media player or digital audio player. The portable media player and the digital audio player are consumer electronics devices capable of storing and playing digital media including audio, images, video, and/or documents. The digital media is stored on a hard drive, microdrive, and/or flash memory. The consumer electronics devices include computers, smartphones, cellphones, internet tablets, tablet computers, digital cameras, and MP3 players. The means to receive the audio signals comprises an open wireless technology standard for exchanging data over distances using short-wavelength radio transmissions. The means to receive the audio signals also comprises audio cables extending to the speaker assembly.

It is therefore one of the main objects of the present invention to provide a safety helmet having speaker assemblies positioned and oriented such so as to provide external audio to the helmet wearer without blocking surrounding sound.

It is another object of the present invention to provide a safety helmet having speaker assemblies that do not affecting safety aspects of the helmet.

It is another object of the present invention to provide a safety helmet having speaker assemblies that transmits audio signals to a speaker system contained in the safety helmet.

It is another object of the present invention to provide a safety helmet having speaker assemblies that is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
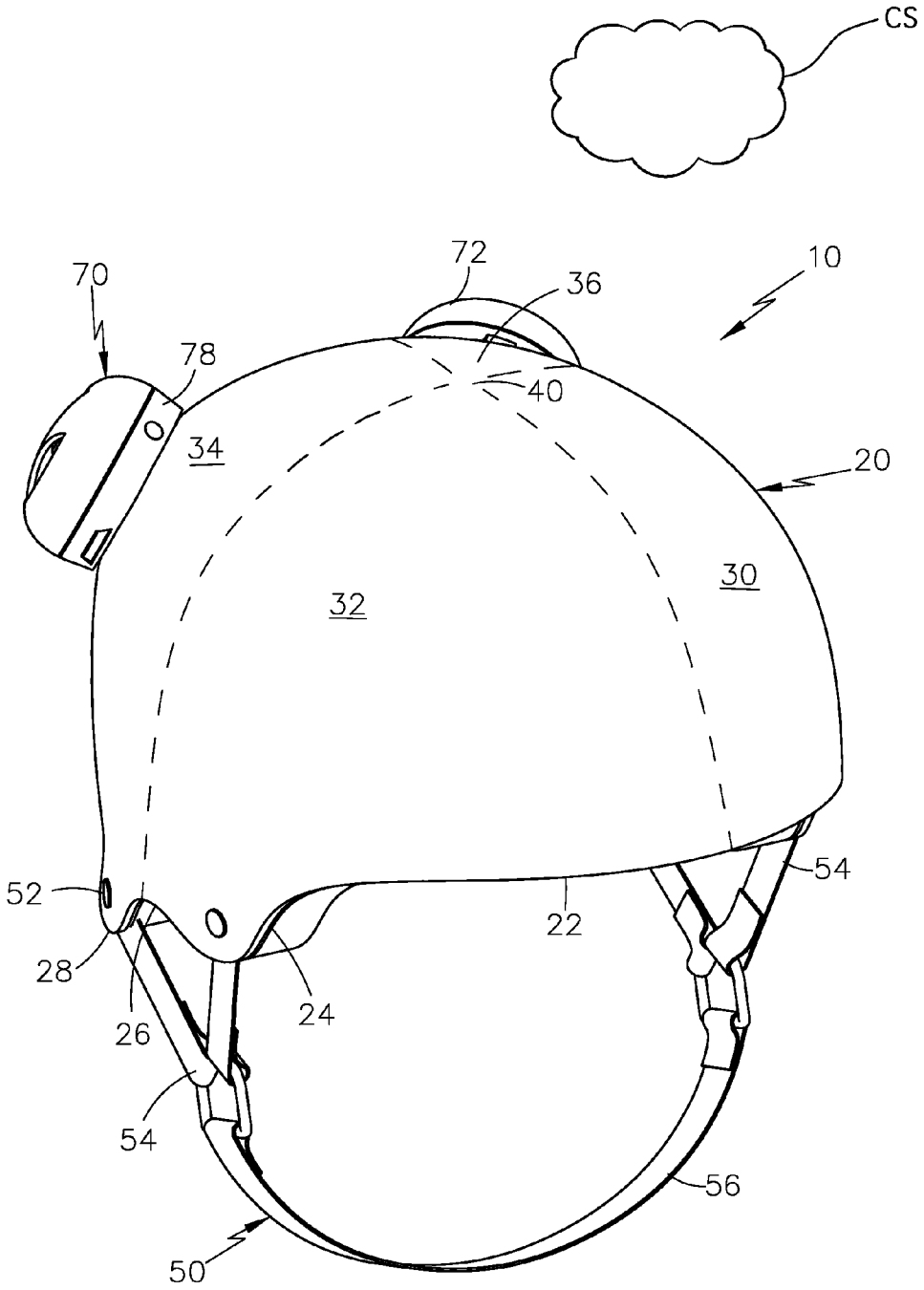
FIG. 1 represents a first isometric front view of the present invention.
Figure 2:
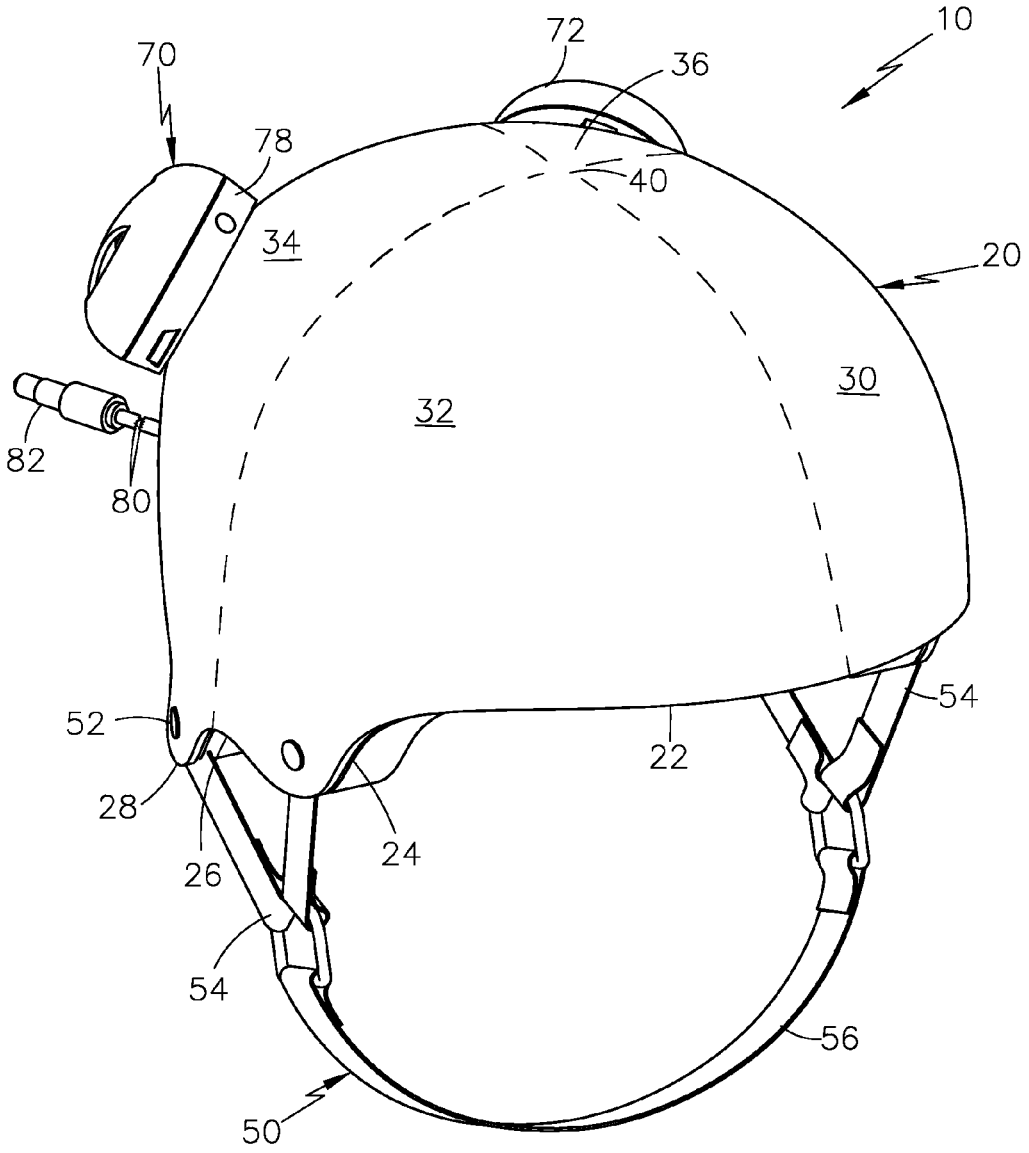
FIG. 2 represents a second isometric front view of the present invention.

Referring now to the drawings, the present invention is a safety helmet and is generally referred to with numeral 10. It can be observed that it basically includes helmet 20 and speaker assembly 70.

As seen in FIGS. 1, 2, 3, and 4, in a preferred embodiment, present invention 10 is a sports helmet, as helmet 20, with portable audio sound producing capabilities, audio signals, emanating from speaker assembly 70, for use on a wearer's head during physical exercise or sports activities at which head injuries are to be protected against. Helmet 20 may comprise a protective shell head covering composed of impact absorbing material. Strap assembly 50 provides for removably fastening helmet 20 on the wearer's head. Speaker assembly 70 comprises at least one speaker aimed outwardly from helmet 20 so that sound emanating therefrom is primarily directed approximately perpendicularly from an outside surface, the protective shell head covering of helmet 20.

Helmet 20 comprises the protective shell head covering defined by front edge 22 and rear edge 29. Helmet 20 also comprises lateral edges, which comprise temple edge 24, ear edges 26, and lower edges 28. Extending from front edge 22 are first and second forward quadrants, defined as forward left quadrant 30 and forward right quadrant 32 respectively. Extending from rear edge 29 are first and second rear quadrants, defined as rear right quadrant 34 and rear left quadrant 36, that extend to forward right quadrant 32 and forward left quadrant 30 respectively. Extending from the first lateral edge are forward left quadrant 30 and rear left quadrant 36. Extending from the second lateral edge are forward right quadrant 32 and rear right quadrant 34 to forward left quadrant 30 and rear left quadrant 36 respectively. It is noted that forward left quadrant 30 and forward right quadrant 32 and rear right quadrant 34 and rear left quadrant 36 are equal in area and meet at apex area 40 of helmet 20. The reference horizontal midline, for illustrative purposes only, extends from a lateral edge to the opposite lateral edge. The reference vertical midline, for illustrative purposes only, extends from front edge 22 to rear edge 29. The reference horizontal and vertical midlines are perpendicular to each other, and they intersect at apex area 40 of helmet 20.

Figure 3:
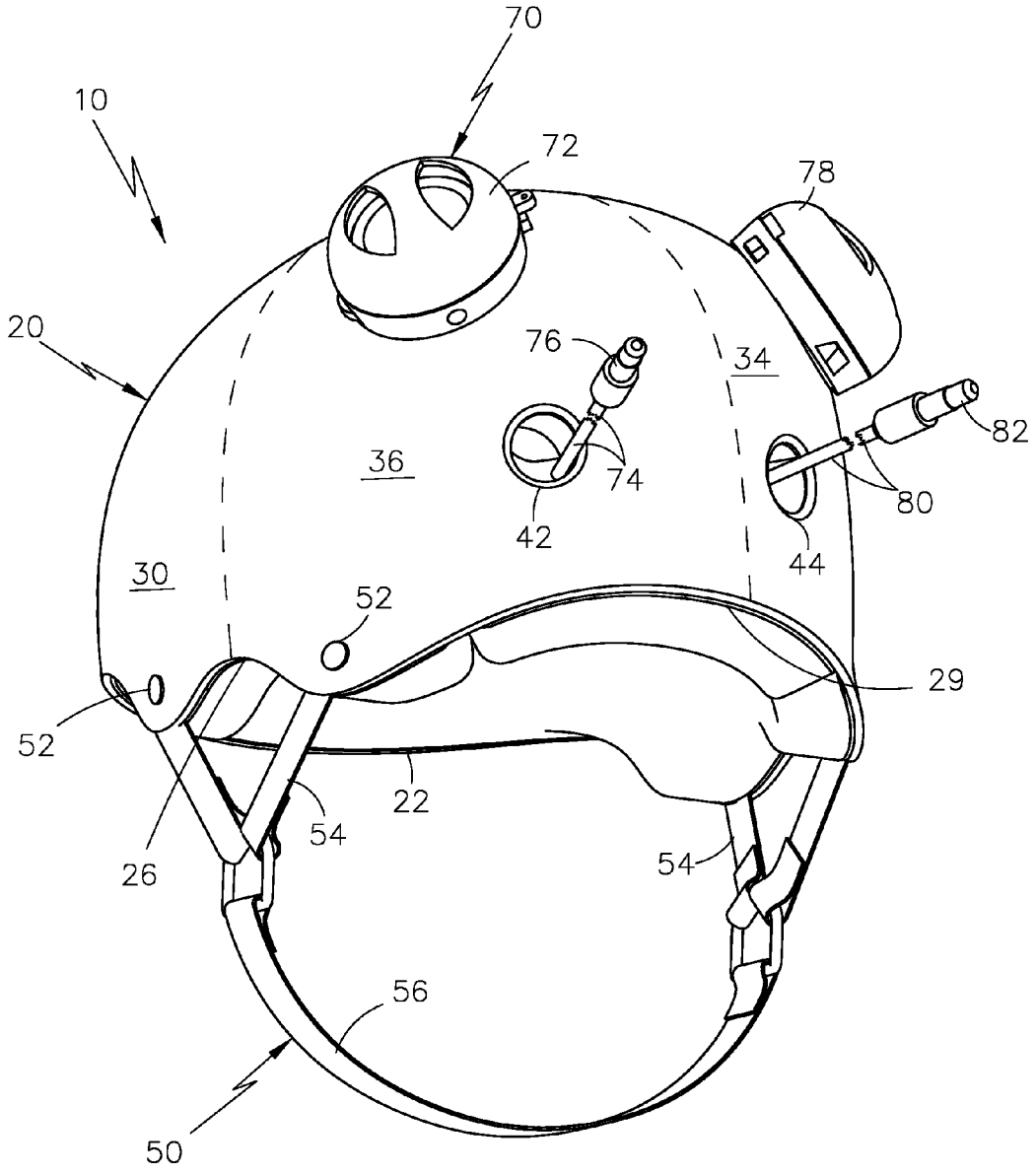
FIG. 3 represents an isometric rear view of the present invention.

As best seen in FIG. 3, helmet 20 comprises access holes 42 and 44. Access hole 42 is disposed at rear left quadrant 36 at a predetermined distance from rear edge 29, and access hole 44 is disposed at rear right quadrant 34 at a second predetermined distance from rear edge 29.

Strap assembly 50 comprises connectors 52, secondary straps 54, and primary strap 56. Connectors 52 are mounted adjacent to the lateral edges. Specifically, connectors 52 are mounted adjacent to ear edges 26 and front edge 22, and to ear edges 26 and lower edges 28. Secondary straps 54 extend from connectors 52. Distal ends of each of secondary straps 54 mount to primary strap 56.

Figure 4:
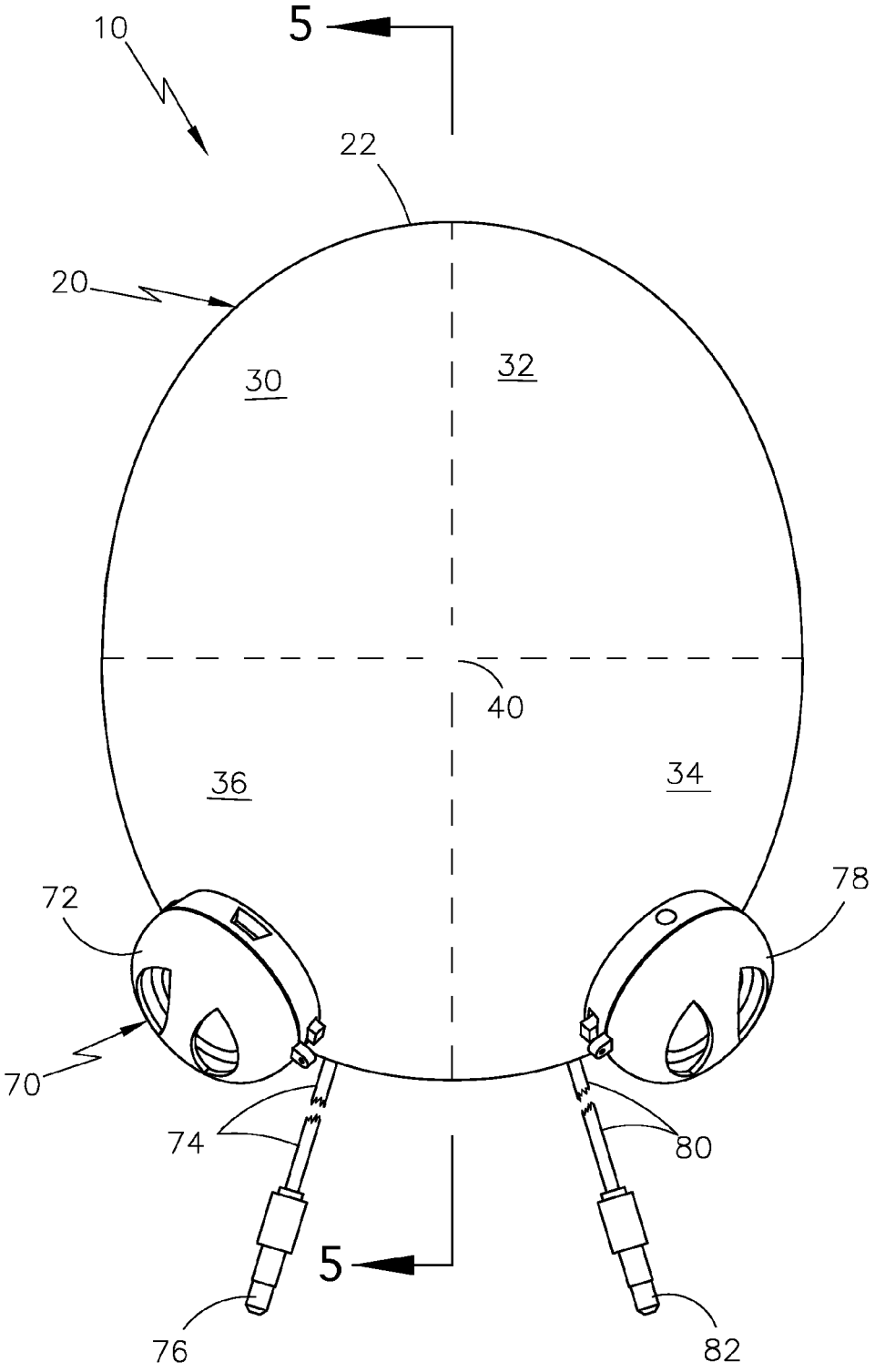
FIG. 4 is a top view of the present invention.
Figure 5:
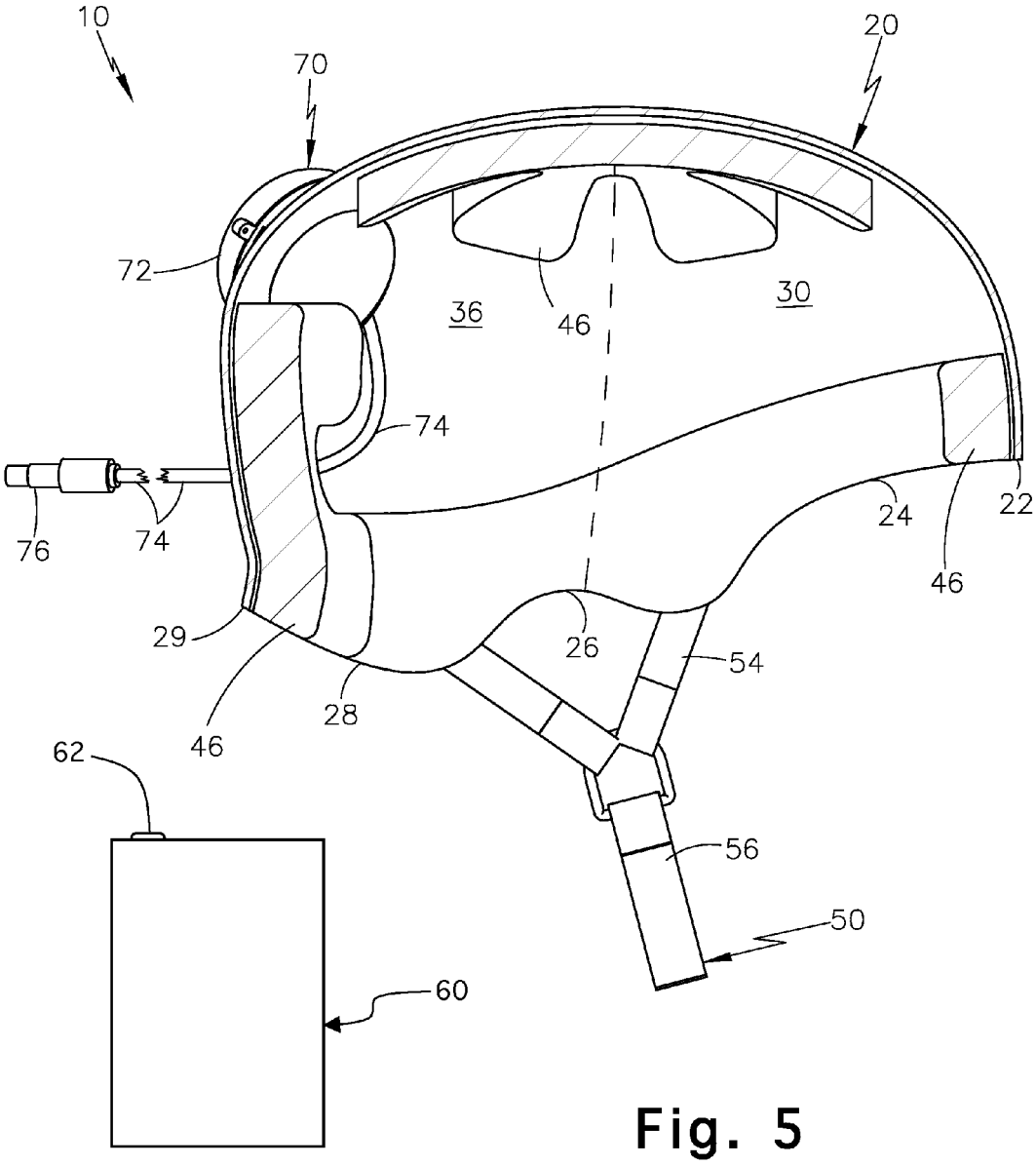
FIG. 5 is a sectional view of the present invention taken along the lines 5-5 seen in FIG. 4.

As seen in FIGS. 4 and 5, speaker assembly 70 is integrally mounted onto helmet 20. In a preferred embodiment, speaker assembly 70 is positioned directly above or rearward of the wearer's ear canals. With the strategic placement of speaker assembly 70, sounds, warnings, and/or communications from surroundings can also be heard by the wearer utilizing present invention 10. Portable sound signal-producing device 60 communicates signals to speaker assembly 70 for causing sounds to be emitted therefrom during physical exercise or sports activity. Speaker assembly 70 comprises at least one speaker, and speakers 72 and 78 may be similarly provided for stereo sound.

Sound is a sequence of waves of pressure that propagates through compressible media such as air or water. Sound can propagate through solids as well, but there are additional modes of propagation. Sound that is perceptible by humans has frequencies from about 20 Hz to 20,000 Hz. In air at standard temperature and pressure, the corresponding wavelengths of sound waves range from 17 m to 17 mm. During propagation, waves can be reflected, refracted, or attenuated by the medium. The behavior of sound propagation is generally affected by three things:

a) a relationship between density and pressure. This relationship, affected by temperature, determines the speed of sound within the medium;

b) the propagation is also affected by the motion of the medium itself. For example, sound moving through wind. Independent of the motion of sound through the medium, if the medium is moving, the sound is further transported; and c) the viscosity of the medium also affects the motion of sound waves. It determines the rate at which sound is attenuated. For many media, such as air or water, attenuation due to viscosity is negligible.

When sound is moving through a medium that does not have constant physical properties, it may be refracted (either dispersed or focused). Sound is transmitted through gases, plasma, and liquids as longitudinal waves, also called compression waves. Through solids, however, it can be transmitted as both longitudinal waves and transverse waves. Longitudinal sound waves are waves of alternating pressure deviations from the equilibrium pressure, causing local regions of compression and rarefaction, while transverse waves (in solids) are waves of alternating shear stress at right angle to the direction of propagation. Matter in the medium is periodically displaced by a sound wave, and thus oscillates. The energy carried by the sound wave converts back and forth between the potential energy of the extra compression (in case of longitudinal waves) or lateral displacement strain (in case of transverse waves) of the matter and the kinetic energy of the oscillations of the medium.

The at least one speaker of speaker assembly 70 can be mounted anywhere on helmet 20. In one embodiment, the at least one speaker of speaker assembly 70 is mounted at right and left rear quadrants 34 and 36 respectively, and aimed outwardly therefrom emanating sound directed approximately perpendicularly from the protective shell head covering such so as to provide external audio without blocking surrounding sound, and without affecting safety aspects of helmet 20. Speaker assembly 70 comprises at least one speaker, and may comprise speakers 72 and 78, as illustrated. Speaker assembly 70 also comprises means to receive the audio signals.

Files, data, audio, and/or content for the audio signals may be stored, and/or may emanate from various sources. One such source is cloud storage CS, seen in FIG. 1. Cloud storage is a model of networked online storage where data is stored in virtualized pools of storage, which are generally hosted by third parties. Hosting companies operate large data centers, and people who require their data to be hosted buy or lease storage capacity from them. The data center operators, in the background, virtualize the resources according to the requirements of a customer and expose them as storage pools, which the customers can themselves use to store files and data objects including the audio signals. Physically, the resource may span across multiple servers.

As an example, "iCloud" is a cloud storage and cloud computing service from Apple Inc. The service allows users to store data such as music, the audio signals, and "iOS" applications on remote computer servers for download to multiple devices such as "iOS"-based devices running "iOS 5" or later, and personal computers running "OS X 10.7.2" "Lion" or later, or "Microsoft Windows" ("Windows Vista" service pack 2 or later). It also acts as a data-syncing center for email, contacts, calendars, bookmarks, notes, reminders (to-do lists), "iWork" documents, and other data. The service also allows users to wirelessly back-up their "iOS" devices to "iCloud" instead of manually doing so using "iTunes".

As seen in FIG. 5, the audio signals may also emanate from portable sound signal-producing device 60. The means to receive audio signals from portable sound signal-producing device 60 may comprise audio cables 74 and 80 extending from at least one port 62 to speaker assembly 70, whereby speaker 72 is connected to audio cable 74 having plug 76 at its distal end, and speaker 78 is connected to audio cable 80 having plug 82 at its distal end. It is noted that audio cables 74 and 80 may also include Y cables, or splitter cables having a plug to insert into at least one port 62 of portable sound signal-producing device 60.

As best seen in FIG. 5, in one embodiment cable 74 is connected to speaker 72 and exits through access hole 42. For safety and comfort, helmet 20 also has lining/padding 46.

Portable sound signal-producing device 60 is a portable media player or digital audio player. Portable media player and the digital audio player are consumer electronics devices capable of storing and playing digital media including audio, images, video, and documents. The digital media is stored on a hard drive, microdrive, or flash memory. The consumer electronics devices include computers, smartphones, cellphones, internet tablets, tablet computers, digital cameras, and MP3 players.

The means to receive the audio signals may also comprise an open wireless technology standard for exchanging data over distances using short-wavelength radio transmissions. Such a technology, as an example, is "Bluetooth". "Bluetooth" is a wireless technology standard for exchanging data over short distances (using short-wavelength radio transmissions in the ISM band from 2400-2480 MHz) from fixed and mobile devices, such as portable sound signal-producing device 60 seen in FIG. 5, creating personal area networks (PANs) with high levels of security. It can connect several devices, overcoming problems of synchronization. It is noted that when utilizing the open wireless technology standard, helmet 20 does not require audio cables 74 and 80 as seen in FIG. 1.

Figure 6:
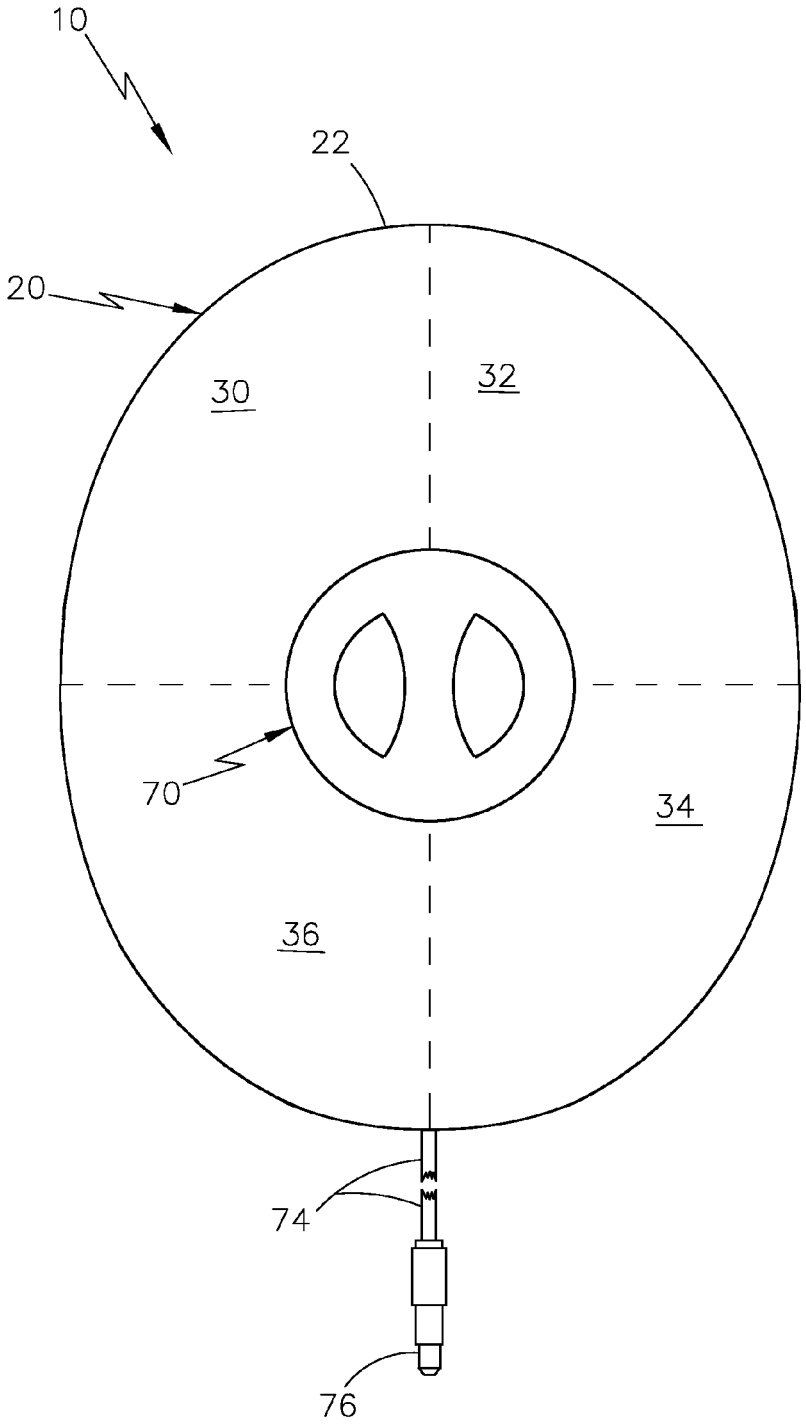
FIG. 6 is a top view of an alternate embodiment of the present invention.

As seen in FIG. 6, speaker assembly 70 may be mounted onto any section of helmet 20. In one embodiment, the at least one speaker of speaker assembly 70 is mounted at apex area 40 and aimed outwardly therefrom emanating sound directed approximately perpendicularly from the protective shell head covering such so as to provide external audio without blocking surrounding sound, and without affecting safety aspects of helmet 20; and as illustrated, may be countersunk into helmet 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A safety helmet, comprising:

A) a helmet comprising an apex area and front and rear edges, and lateral edges;

B) a speaker assembly comprising at least one speaker mounted onto said apex area of said helmet and aimed outwardly therefrom, said at least one speaker emanates sound directed approximately perpendicularly from said helmet without blocking surrounding sound, said speaker assembly comprising means to receive audio signals, said audio signals stream through a portable sound signal-producing device that is a portable media player or digital audio player, said portable media player and said digital audio player are consumer electronics devices capable of storing and playing digital media including audio, images, video, and/or documents, said digital media is stored on a hard drive, microdrive, and/or flash memory; and C) a strap assembly.

2. The safety helmet set forth in claim 1, further characterized in that said speaker assembly is integrally mounted onto said helmet.

3. The safety helmet set forth in claim 1, further characterized in that said at least one speaker is countersunk.

4. The safety helmet set forth in claim 1, further characterized in that said audio signals are stored in cloud storage.

5. The safety helmet set forth in claim 1, further characterized in that said consumer electronics devices include computers, smartphones, cellphones, internet tablets, tablet computers, digital cameras, and MP3 players.

6. The safety helmet set forth in claim 1, further characterized in that said means to receive said audio signals comprises an open wireless technology.

7. The safety helmet set forth in claim 1, further characterized in that said means to receive said audio signals comprises an open wireless technology standard for exchanging data over distances.

8. The safety helmet set forth in claim 1, further characterized in that said means to receive said audio signals comprises an open wireless technology standard for exchanging data over distances using radio transmissions.

9. The safety helmet set forth in claim 1, further characterized in that said means to receive said audio signals comprises an open wireless technology standard for exchanging data over distances using short-wavelength radio transmissions.

10. The safety helmet set forth in claim 1, further characterized in that said means to receive said audio signals comprises audio cables.

11. The safety helmet set forth in claim 1, further characterized in that said means to receive said audio signals comprises audio cables extending therefrom.

12. The safety helmet set forth in claim 1, further characterized in that said means to receive said audio signals comprises audio cables extending to said speaker assembly.

13. A safety helmet, comprising:

A) a helmet comprising front and rear edges, lateral edges, and an apex area, extending from said front edge are first and second forward quadrants, and extending from said rear edge are first and second rear quadrants;

B) a speaker assembly comprising at least one speaker mounted onto said first and/or second forward quadrants of said helmet and aimed outwardly therefrom, said at least one speaker emanates sound directed approximately perpendicularly from said helmet without blocking surrounding sound, said speaker assembly comprising means to receive audio signals, said audio signals stream through a portable sound signal-producing device that is a portable media player or digital audio player, said portable media player and said digital audio player are consumer electronics devices capable of storing and playing digital media including audio, images, video, and/or documents, said digital media is stored on a hard drive, microdrive, and/or flash memory; and C) a strap assembly.

14. A safety helmet, comprising:

A) a helmet comprising front and rear edges, lateral edges, and an apex area, extending from said front edge are first and second forward quadrants, and extending from said rear edge are first and second rear quadrants;

B) a speaker assembly comprising at least one speaker mounted onto said first and/or second rear quadrants of said helmet and aimed outwardly therefrom, said at least one speaker emanates sound directed approximately perpendicularly from said helmet without blocking surrounding sound, said speaker assembly comprising means to receive audio signals, said audio signals stream through a portable sound signal-producing device that is a portable media player or digital audio player, said portable media player and said digital audio player are consumer electronics devices capable of storing and playing digital media including audio, images, video, and/or documents, said digital media is stored on a hard drive, microdrive, and/or flash memory; and C) a strap assembly.

* * * * *